US007396107B2

(12) United States Patent
Snyder et al.

(10) Patent No.: US 7,396,107 B2
(45) Date of Patent: Jul. 8, 2008

(54) INK JET PRINTING WITH LOW COVERAGE SECOND PASS

(75) Inventors: Trevor J. Snyder, Newberg, OR (US); David L. Knierim, Wilsonville, OR (US); Christine M. Greiser, West Linn, OR (US); James B. Jensen, Woodburn, OR (US); Brent E. Fleming, Aloha, OR (US); James B. Campbell, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 479 days.

(21) Appl. No.: 11/196,565

(22) Filed: Aug. 2, 2005

(65) Prior Publication Data

US 2007/0030323 A1 Feb. 8, 2007

(51) Int. Cl.
*B41J 2/15* (2006.01)

(52) U.S. Cl. ..... 347/41

(58) Field of Classification Search ..... 347/12, 347/15, 40, 41, 43
See application file for complete search history.

(56) References Cited

U.S. PATENT DOCUMENTS 4,920,355 A * 4/1990 Katerberg ..... 347/41
5,625,390 A 4/1997 Burke et al.
5,734,393 A 3/1998 Eriksen
5,949,452 A 9/1999 Jones
5,971,524 A 10/1999 Nicoloff, Jr. et al.
5,979,310 A 11/1999 Nagarsheth et al.
6,328,419 B2 * 12/2001 Otsuki ..... 347/41
2001/0015734 A1 8/2001 Kanda et al.

FOREIGN PATENT DOCUMENTS

EP 0 694 388 A2 1/1996
EP 1 728 639 A2 12/2006

OTHER PUBLICATIONS

Application No. EP 06 11 7625 European Search Report mailed Dec. 20, 2007.

* cited by examiner

*Primary Examiner*—Lamson D. Nguyen
(74) *Attorney, Agent, or Firm*—Fay Sharpe, LLP

(57) ABSTRACT

A method of operating an ink jet printer including printing a first image having substantially solid fill regions on a transfer surface disposed on a print drum, printing a second image on the first image, wherein the second image comprises solid or dithered fill regions that correspond to portions of some of the solid fill regions of the interlaced image, and wherein the second image has a dot density that is less than a dot density of the first image.

14 Claims, 3 Drawing Sheets

INK JET PRINTING WITH LOW COVERAGE SECOND PASS

BACKGROUND

The subject disclosure is generally directed to color printing.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

DETAILED DESCRIPTION

Figure 1:
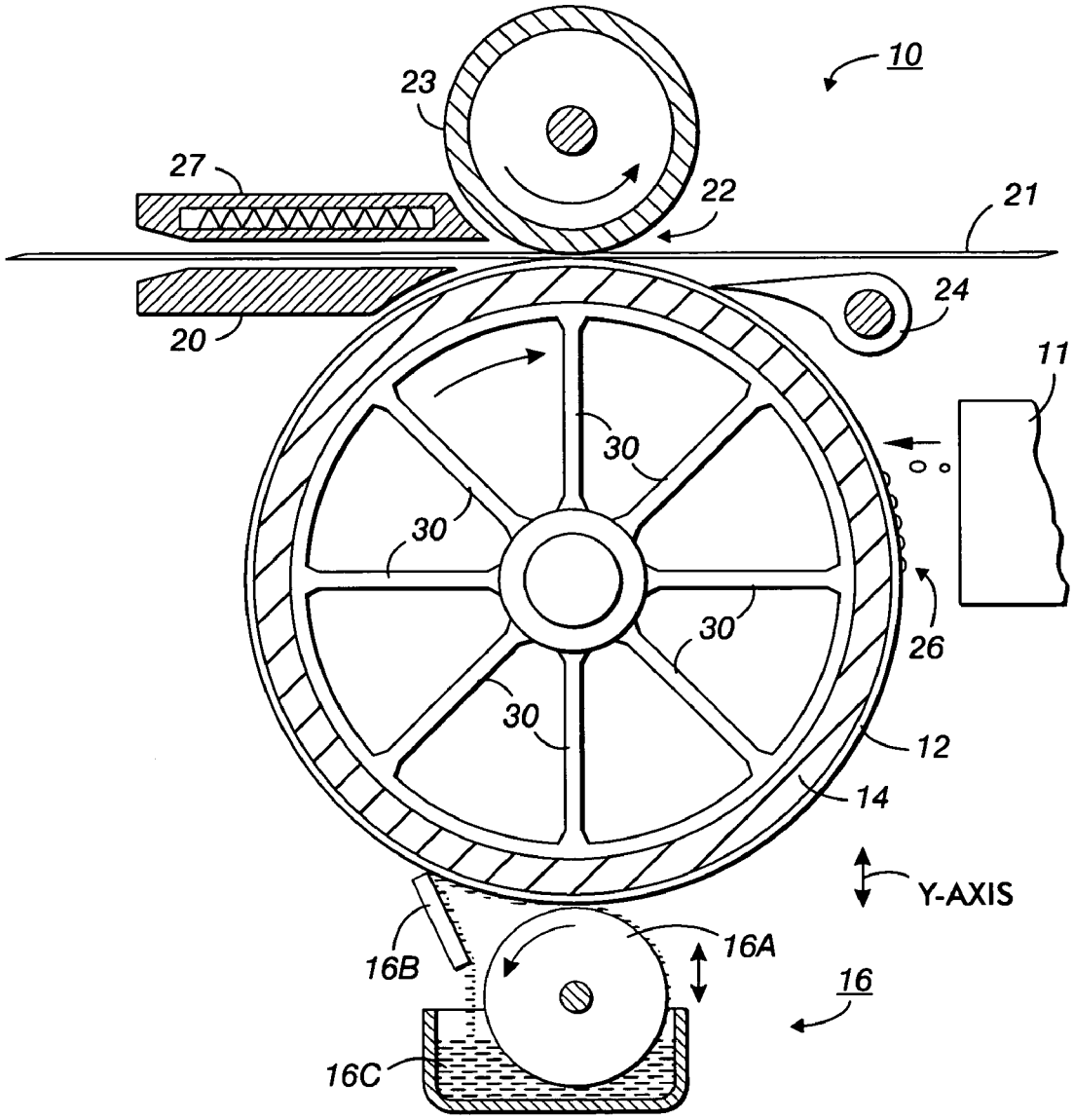
FIG. 1 is a schematic block diagram of an embodiment of a printing apparatus.

FIG. 1 is a schematic block diagram of an embodiment of a printing apparatus 10 in which the disclosed techniques can be employed. The printing apparatus includes a printhead 11 that is appropriately supported for moving utilization to emit drops 26 of ink onto an intermediate transfer surface 12 applied to a supporting surface of a print drum 14 that is rotatable about an axis of rotation that is parallel to an X-axis (FIG. 2) that is orthogonal to the plane of FIG. 1. The ink can be melted solid or phase change ink, for example, and the print drum 14 can be heated. The intermediate transfer surface 12 can be a liquid layer such as a functional oil that can be applied by contact with an applicator such as a roller 16A of an applicator assembly 16. By way of illustrative example, the applicator assembly 16 can include a housing 16C that supports the roller 16A and a metering blade 16B. The housing 16C can function as a reservoir for containing the liquid that is removed from the print drum by the metering blade. The applicator assembly 16 can be configured for selective engagement with the print drum 14.

The printing apparatus 10 further includes a substrate guide 20 and a media preheater 27 that guides a print media substrate 21, such as paper, through a nip 22 formed between opposing acutated surfaces of a transfer roller 23 and the intermediate transfer surface 12 supported by the print drum 14. The transfer roller is selectively movable into contact with the intermediate transfer surface 12. Stripper fingers 24 can be pivotally mounted to assist in removing the print medium substrate 21 from the intermediate transfer surface 12 after an image 26 comprising deposited ink drops is transferred to the print medium substrate 21.

Figure 2:
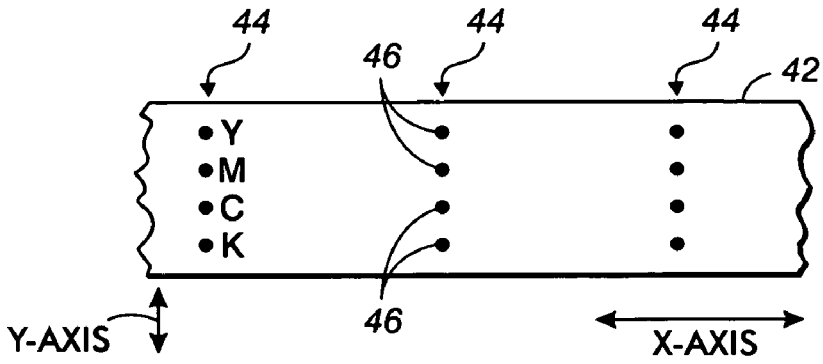
FIG. 2 is a schematic view of a portion of an embodiment of a face of an ink jet printhead of the printing of FIG. 1.

FIG. 2 schematically depicts an embodiment of a portion of a face of a printhead 11 having substantially mutually parallel columnar arrays 44 of nozzles 46. Each columnar array 44 can include a number of nozzles 46, for example one for each of primary colors such as cyan (C), magenta (M), yellow (Y), and black (K). The nozzles 46 in each columnar array 44 can be co-linear or slightly offset along the X-axis, for example. The columnar arrays can be substantially parallel to a Y-axis that is orthogonal to the X-axis and in line or aligned with the rotation of the print drum 14. The ink drops deposited by each columnar array in a revolution of the print drum comprise a scan line. Each scan line can comprise drops from any of the nozzles that deposit a particular scan line. Each scan line is substantially parallel to the Y-axis.

Printing an image on the transfer surface 12 can be accomplished for example by rotating the print drum in a first direction (e.g., clockwise as viewed in FIG. 1), moving the applicator assembly into contact with the print drum to form the transfer surface, moving the applicator assembly away from the print drum after the transfer surface has been formed, depositing drops onto the transfer surface during a plurality of revolutions or passes of the print drum, and appropriately translationally moving the printhead along the X-axis. For example, the printhead can be moved in increments (one for each print drum revolution, for example). Also, the printhead can be moved at a constant slew speed while the print drum rotates. In this manner, an image printed on the transfer surface 12 over a plurality of revolutions of the print drum comprises a plurality of interlaced scan lines.

Figure 3:
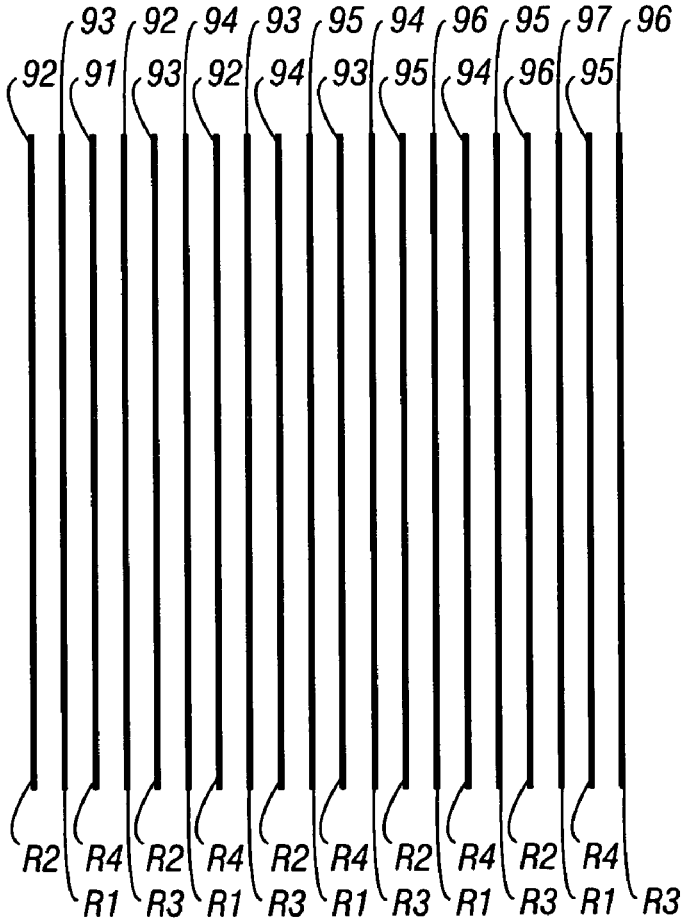
FIG. 3 is a simplified schematic illustration of an embodiment of interlaced scan lines.

FIG. 3 is a simplified schematic illustration of an embodiment of interlaced scan lines that can be produced using a printhead having nozzle columnar arrays that are spaced four scan lines apart along the X-axis, and wherein the printhead is advanced three scan lines along the X-axis after each print drum revolution. The scan line 91 represents a set of scan lines printed by a first nozzle, the scan lines 92 represent a second set of scan lines printed by a second nozzle, the scan lines 93 represent a third set of scan lines printed by a third nozzle, the scan lines 94 represent a fourth set of scan lines printed by a fourth nozzle, the scan lines 95 represent a fifth set of scan lines printed by a fifth nozzle, the scan lines 96 represent a sixth set of scan lines printed by a sixth nozzle, and the scan lines 97 represent a seventh set of scan lines printed by a seventh nozzle. The particular drum revolution during which a scan line is printed is indicated by R1 through R4. The number of sets of scan lines and the spacing between sets of scan lines can depend on the desired dot density along the X-axis (sometimes expressed as dots per inch) and the spacing between columnar arrays 44 of nozzles 46 (FIG. 2). In practice, an image can be formed using a greater number of print drum revolutions, for example six wherein the printhead is advanced five scan lines after each print drum revolution.

An image can also be printed in a single pass or revolution of the print drum, in which case the X-axis dot density would be defined by the spacing between the columnar arrays of nozzles.

The deposited image can further include a Y-axis density that is measured orthogonally to the X-axis, for example along the direction of rotation of the print drum. The Y-axis dot density can be visualized as being parallel to the Y-axis when the image is flattened to plane that is parallel to the X-axis and the Y-axis. The Y-axis dot density can be controlled by the rotation speed of the print drum and the drop timing of the printhead. In this manner, the deposited image has a two-dimensional dot density X by Y which can be expressed as X×Y.

After an entire image is deposited onto the transfer surface 12, the deposited image is transferred to the print media substrate by moving the transfer roller into contact with the transfer surface 12 and moving the print media substrate 21 into the nip formed between the transfer roller and the intermediate transfer surface 12. Continued rotation of the print drum 14 causes the print media substrate to pass through the nip, and a combination of pressure in the nip and heat causes the deposited image to transfer from the print drum and fuse to the print media substrate 21. The transfer roller 23 is moved away from the print drum 14 after the image has been transferred.

Figure 4:
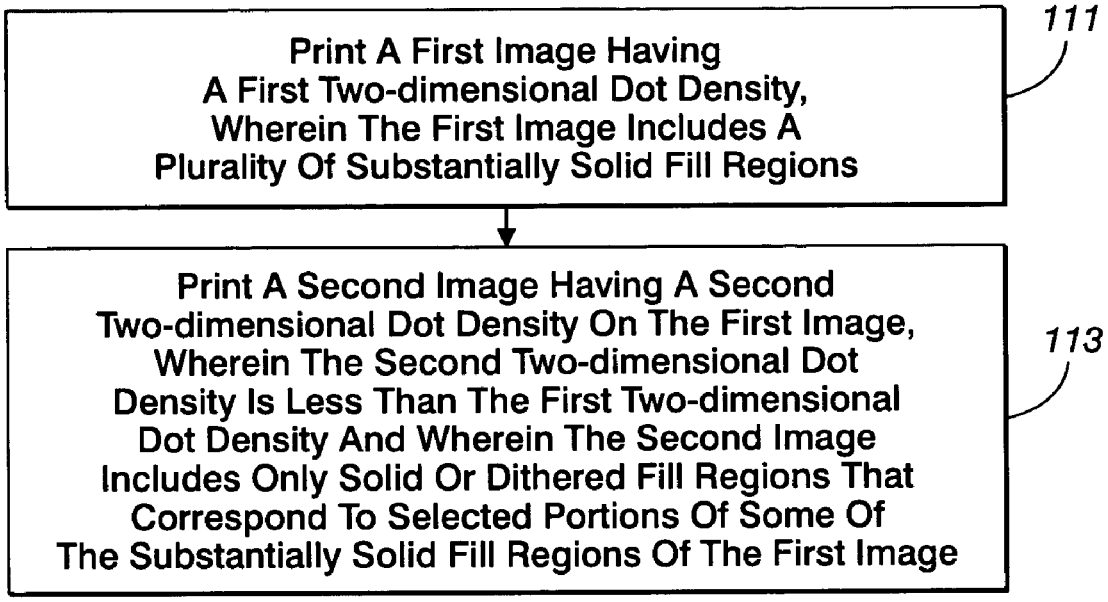
FIG. 4 is a flow diagram of an embodiment of a procedure for printing.

FIG. 4 is a flow diagram of an embodiment of a procedure for printing. At 111 a first image having substantially solid fill regions is deposited or printed on the print drum at a first predetermined two-dimensional X-axis by Y-axis dot resolution or density X1×Y1. Substantially solid fill regions can have at least about 90 or 95 percent coverage, for example. At 113 a second image is deposited or printed on or over the first image at second predetermined two-dimensional X-axis by Y-axis dot resolution or density X2×Y2 that is less than the first predetermined dot density X1×Y1, wherein the second image comprises solid or dithered fill regions that correspond to selected portions of some of the substantially solid fill regions of the first image. In this manner, portions of some of the substantially solid fill regions of the first image are printed again at a lower two-dimensional dot density such that the second image comprises dots that are more sparsely located than the dots of the first image. By way of specific example, the second image can comprise only regions that correspond to portions of some of the substantially solid fill regions of the first image.

The second two-dimensional dot density X2×Y2 is less than the first two-dimensional dot density X1×Y1 in the sense that the product of X2 times Y2 is less than the product of X1 times Y1. Alternatively, the second two-dimensional dot density X2×Y2 can be less than the first two-dimensional dot density X1×Y1 in the sense that X2 is less than X1 and Y2 is not greater than Y1, or X2 is not greater than X1 and Y2 is less than Y1.

By way of illustrative example, the first image can comprise interlaced scan lines that are deposited using a plurality of print drum revolutions, while the second image can comprise non-interlaced scan lines that are deposited using at most a single print drum revolution. More generally, the first image can be printed using a first number of revolutions of the print drum, and the second image can be printed using a second number of revolutions of the print drum that is less than the first number of revolutions. In the case where the second image is printed using a single revolution of the print drum, the X-axis dot density is determined by the physical X-axis dot density of the printhead.

For the particular example of a printhead having an X axis nozzle density of 100 nozzles per inch, a first number of drum revolutions of 6 would provide a first image resolution of 600 dots per inch along the X axis. If the jet firing frequency is 30 KHz and the drum surface velocity is 50 inches per second, then the first image resolution in the Y axis is also 600 dots per inch. This results in a two-dimensional dot density of 600×600, which provides for 360000 dots per square inch. Printing a second image in a single drum revolution at a jet firing frequency of 15 KHz and a drum surface velocity of 50 inches per second yields a two-dimensional dot density of 100×300, which provides for 30000 dots per square inch.

By way of illustrative example, the selected portions of the substantially solid fill regions can comprise line segments formed of at least a predetermined number of contiguous dots. As another example, a selected portion of a substantially solid fill region can comprise a plurality of contiguously adjacent line segments, each line segment formed of at least a predetermined number of contiguous dots. Also, a selected portion of a substantially solid fill region can comprise a region wherein substantially all of the dots (e.g., at least about 95 percent) are of the same color.

By way of illustrative examples, a solid or dithered fill region of the second image can be printed using a single primary color or a plurality of primary colors that form a secondary color. The color (primary or secondary) of a solid or dithered fill region of the second image can correspond to the color of the corresponding portion of a substantially solid fill region of the first image. As another example, the color of a solid or dithered fill region of the second image can be one of a plurality of primary colors printed in the corresponding portion of a substantially solid fill region of the first image.

By way of specific example, a solid or dithered fill region of the second image can comprise cyan, magenta and yellow where the corresponding portion of a substantially solid fill region of the first image is black.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating an ink jet printer having a print drum and a printhead that selectively deposits drops of ink on a transfer surface disposed on the print drum, comprising:

printing a first image having substantially solid fill regions on the transfer surface, the first image having a first two-dimensional dot density;

printing a second image on the first image, the second image having second two-dimensional dot density that is less than the first two-dimensional dot density;

wherein the second image comprises fill regions that correspond to selected portions of some of the substantially solid fill regions of the first image.

2. The method of claim 1 wherein the second image comprises solid fill regions that correspond to selected portions of some of the substantially solid fill regions of the first image.

3. The method of claim 1 wherein the second image comprises dithered fill regions that correspond to selected portions of some of the substantially solid fill regions of the first image.

4. The method of claim 1 wherein:

the first image is printed using a first number of revolutions of the print drum; and the second image is printed using a second number of revolutions of the print drum that is less than the first number of revolutions.

5. The method of claim 1 wherein:

the first image is printed at a first X-axis dot density;

the second image is printed at a second X-axis dot density that is less than the first X-axis dot density;

the first X-axis dot density and the second X-axis dot density are measured parallel to an axis of rotation of the imaging drum.

6. The method of claim 1 wherein:

the first image is printed at a first Y-axis dot density;

the second image is printed at a second Y-axis dot density that is less than the first Y-axis dot density.

7. The method of claim 1 wherein one of the fill regions of the second image is printed with a single color.

8. The method of claim 1 wherein one of the selected portions of some of the substantially solid fill regions of the first image is printed using black and wherein a corresponding fill region of the second image is printed using cyan, magenta and yellow.

9. A method of operating an ink jet printer having a print drum and a printhead that selectively deposits drops of ink on a transfer surface disposed on the print drum, comprising:

printing a first image having substantially solid fill regions on the transfer surface;

printing a second image on the first image, the second image comprising fill regions that correspond to selected portions of some of the substantially solid fill regions of the first image;

wherein the second image comprises dots that are more sparsely located than dots of the first image.

10. The method of claim 9 wherein:

the first image is printed using a first number of revolutions of the print drum; and the second image is printed using a second number of revolutions of the print drum that is less than the first number of revolutions.

11. The method of claim 9 wherein:

the first image is printed at a first X-axis dot density;

the second image is printed at a second X-axis dot density that is less than the first X-axis dot density;

the first X-axis dot density and the second X-axis dot density are measured parallel to an axis of rotation of the imaging drum.

12. The method of claim 9 wherein:

the first image is printed at a first Y-axis dot density;

the second image is printed at a second Y-axis dot density that is less than the first Y-axis dot density.

13. The method of claim 9 wherein one of the fill regions of the second image is printed with a single color.

14. The method of claim 9 wherein one of the selected portions of some of the substantially solid fill regions of the first image is printed using black and wherein a corresponding fill region of the second image is printed using cyan, magenta and yellow.

* * * * *